United States Patent [19]

Engel

[11] Patent Number: 4,851,801

[45] Date of Patent: Jul. 25, 1989

[54] MICROWAVE C-SWITCHES AND S-SWITCHES

[75] Inventor: Klaus G. Engel, Waterloo, Canada

[73] Assignee: Com Dev Ltd., Cambridge, Canada

[21] Appl. No.: 269,053

[22] Filed: Nov. 9, 1988

[30] Foreign Application Priority Data

Sep. 28, 1988 [CA] Canada ..... 578723

[51] Int. Cl.[4] ..... H01F 7/08

[52] U.S. Cl. ..... 335/230; 335/232

[58] Field of Search ..... 335/78, 80, 81, 92, 335/229, 230, 232, 233, 234

[56] References Cited

U.S. PATENT DOCUMENTS 3,278,873 10/1966 Hilgert ..... 335/232 X 4,339,735 7/1982 Ono et al. ..... 335/232 X

*Primary Examiner*—George Harris

*Attorney, Agent, or Firm*—Daryl W. Schnurr

[57] ABSTRACT

A microwave switch that is an S-switch or a C-switch or the like has an electromagnetic actuator and a plurality of armatures. The armatures moves simultaneously in a linear path in response to the electromagnetic actuator. The actuator has one permanent magnet for each aperture and the switch has at least one coil winding. When an electric current is passed through the winding, the armatures move into a closed or open position, as desired. The only moving parts in the switch are the armatures themselves. The switch does not contain any complex mechanical arrangement or return springs that have been found in previous switches. The mass and volume of the switch as well as the number of moving parts is greatly reduced when compared to previous switches. This is very important when the switch is used in satellites.

15 Claims, 9 Drawing Sheets

PRIOR ART

PRIOR ART

PRIOR ART

MICROWAVE C-SWITCHES AND S-SWITCHES

BACKGROUND OF THE INVENTION

1. Field of the Invention

This invention relates to a microwave switch and, in particular, to a transfer switch that is an S-switch or a C-switch or the like. An S-switch is also referred to as a Double Pole Double Throw switch in the literature. A C-switch is a variation of the S-switch and is also referred to as a Single Pole Double Throw switch.

2. Description of the Prior Art

Transfer switches such as C-switches or S-switches are known and are widely used in the space communications industry. For example, a communications satellite will contain numerous coaxial C-switches and S-switches. Previous switches have a much larger mass and volume than switches of the present invention. Further previous switches have a relatively large number of moving parts and are more complex and expensive to manufacture when compared to switches of the present invention. Also, previous switches cannot attain the same RF performance characteristics as switches of the present invention. Mass and volume are always critical parameters for space applications. Any savings in mass and volume are readily converted to cost savings, or higher communications capacity, or longer life for the satellite or a combination of these factors. Similarly, the reliability of spacecraft components is crucial to the success of the satellite as there are no means for correcting any malfunctions once the satellite is launched. On a relative basis, fewer components with moving parts would therefore enhance the reliability. Previous switches have an activating mechanism that is either a solenoid or an electromagnet, both being used in combination with a complex mechanical arrangement often utilizing return springs. Further, linear electromagnetic actuators that move a single armature in a linear fashion are known. However, these actuators have not been used in microwave switches and have not been used with a plurality of armatures.

SUMMARY OF THE INVENTION

The present invention includes a plurality of armatures thereby realizing a minimum of moving parts and hence increased reliability.

The present microwave switch has a housing containing an electromagnetic actuator and at least two conductor paths interconnecting at least three ports. The actuator has a plurality of armatures and electromagnetic means for moving said armatures. The armatures are seated in said housing and each armature has a first position and a second position that are linearly displaced from one another. Each armature is located relative to the electromagnetic means so that movement of each armature from one position to the other can be controlled by said electromagnetic means simultaneously with the movement of the other armatures. Each armature has connectors thereon so that one conductor path on said switch is connected in one position of the armature and interrupted in the other position. The movement of all of the armatures is co-ordinated so that appropriate paths are connected and interrupted simultaneously. The armature and the connectors mounted thereon are the only moving components of the switch, there being no movable mechanical connection between the electromagnetic means and the armature, the electromagnetic means remaining stationary.

BRIEF DESCRIPTION OF THE DRAWINGS

In drawings, which illustrate a preferred embodiment f the invention.

DESCRIPTION OF A PREFERRED EMBODIMENT

Figure 1A:
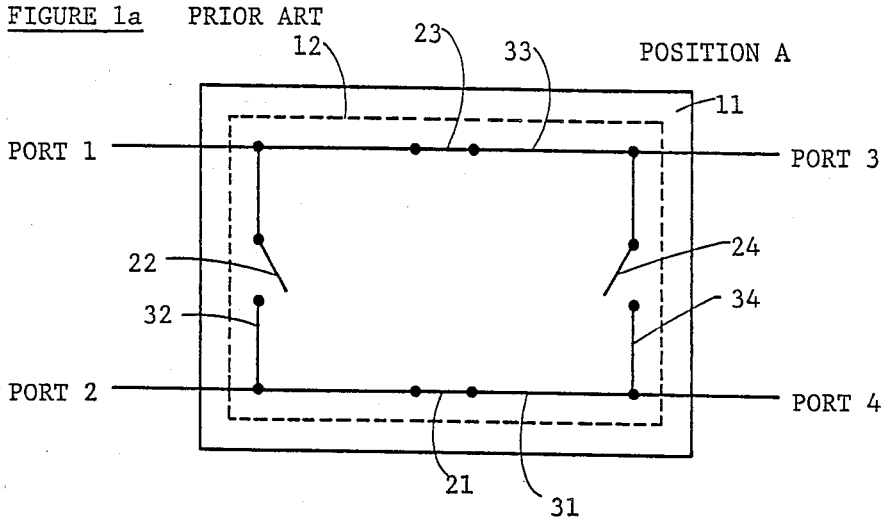
FIGURE 1a PRIOR ART
FIG. 1*a* is a schematic drawing of a prior art coaxial S-switch in position A.
Figure 1B:
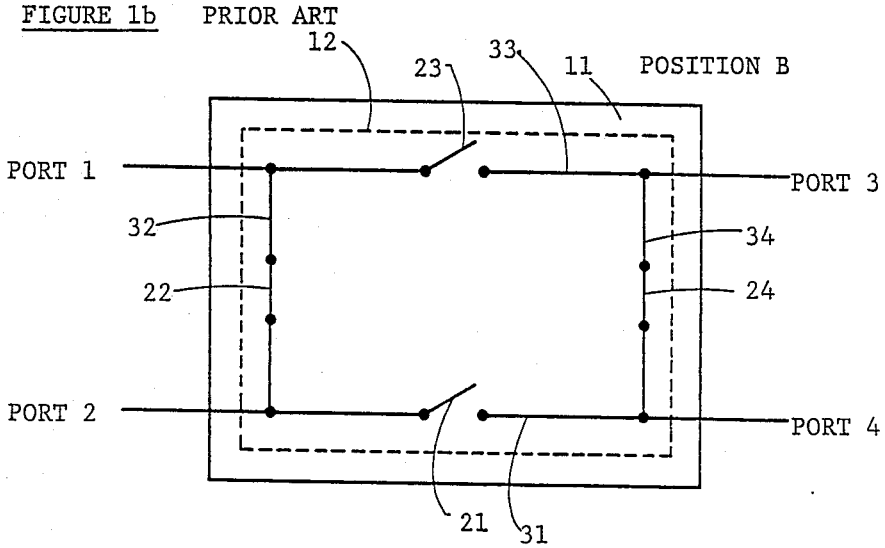
FIGURE 1b PRIOR ART
FIG. 1*b* is a schematic drawing of a prior art coaxial S-switch in position B.

Referring to the figures in greater detail, in FIGS. 1*a* and 1*b*, it can be seen that a coaxial S-switch can be connected from one port to either of two adjacent ports. As the drawings show, FIGS. 1*a* and 1bare schematic views only, the port connections are situated within a housing 11 represented by the outside peripheral or continuous lines that extend beyond an RF cavity shown by the broken lines 12 of the enclosure and represents ports 1, 2, 3 and 4 of the said housing. In FIG. 1*a*, the S-switch is in a first position A with a switch conductor path 31 connecting ports 2 and 4 and conductor path 33 connecting ports 1 and 3. The two conductor paths 31, 33 are closed by switch contacts 21, 23 respectively. There are two remaining paths 32, 34 that are interrupted due to switch contacts 22 and 24 not being connected. In FIG. 1*b*, the S-switch is shown in a secondary position with the conductor path 32 connecting ports 1 and 2 and the conductor path 34 connecting ports 3 and 4. The paths 31 and 33 are interrupted due to switch contacts 21 and 23 being disengaged. Thus, it can be seen that the S-switch shown in FIGS. 1*a* and 1*b* will always have two of the conductor paths connected and two of the conductor paths interrupted at any given time.

Figure 1C:
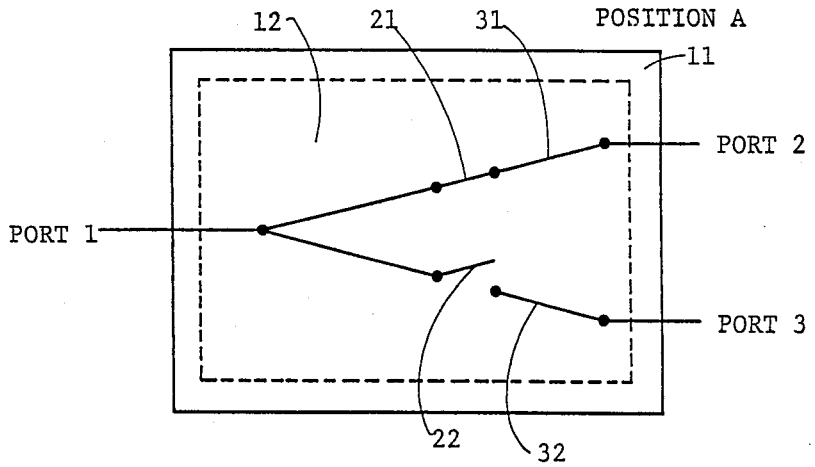
FIGURE 1c PRIOR ART
FIG. 1*c* is a schematic drawing of a prior art coaxial C-switch in position A.
Figure 1D:
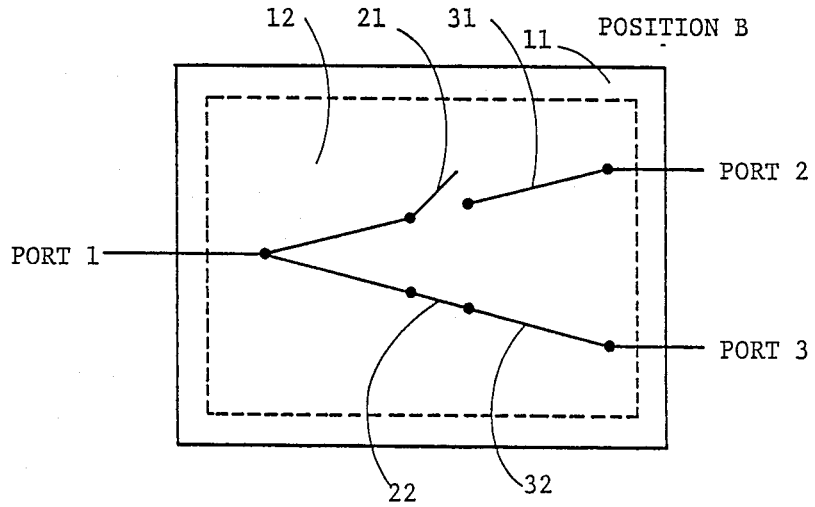
FIGURE 1d PRIOR ART
FIG. 1*d* is schematic drawing of a prior art coaxial C-switch in position B.

In FIG. 1*c*, there is shown a schematic view of a prior art coaxial C-switch. The principle differs from that of the S-switch shown in FIGS. 1*a*, 1*b*, as the C-switch has one input port 1 and two output ports 2, 3. The same reference numerals have been used in FIGS. 1*c* and 1*d* to describe those components that are similar to the components of FIGS. 1*a* and 1*b*. It can readily be seen that the C-switch has two conductor paths 31, 32, each path containing switch means 21, 22 respectively. At any given time, one of the paths 31, 32 is connected and the remaining path is interrupted. As shown in FIG. 1*c*, in position A, the path 31 is connected and the path 32 is interrupted. Alternatively, as shown in FIG. 1*d*, in position B, the path 32 is connected and the path 31 is interrupted.

Figure 2A:
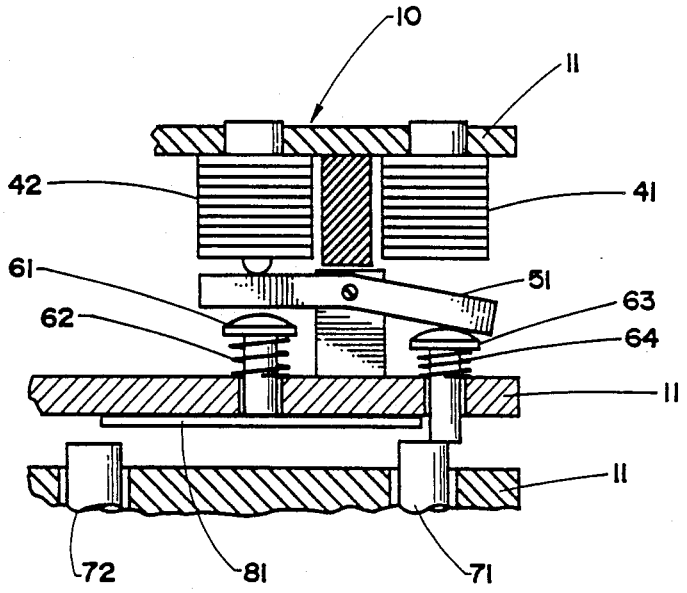
FIGURE 2a PRIOR ART
FIG. 2*a* is a sectional side view of a prior art S-switch having an electromagnetic and clapper arrangement for each switch connecting path that is shown in position A.
Figure 2B:
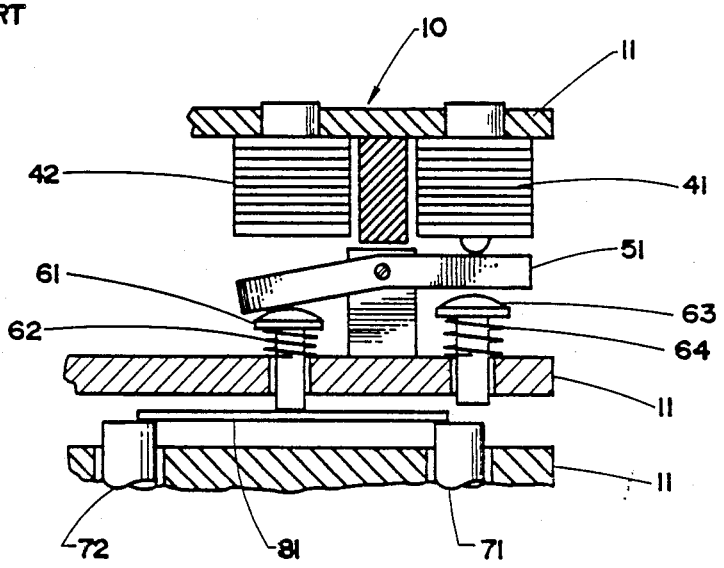
FIG. 2*b* is a sectional side view of the prior art S-switch of FIG. 2*a* shown in position B.

In FIGS. 2*a* and 2*b*, there is shown a side view of a prior art coaxial C-switch 10 having electromagnets 41, 42 mounted within a housing 11 (only part of which is shown). The switch is shown in a first position in FIG. 2*a* where the supply of electrical current to the electromagnet 42 has caused a linear movement with a corresponding force to displace rocker arm 51 about its pivot point causing circular rod 63 to move in a linear direction and make contact with conductor 71. The supply of an electrical current to electromagnet 41 instead of the electromagnet 42 causes a further linear movement that displaces rocker arm 51 to a second position as shown in FIG. 2*b*. The displacement of the rocker arm 51 in turn causes the downward vertical displacement of circular rod 61 that further causes the linear displacement of reed 81, creating an electrical connection between conductors 71 and 72. Simultaneously with this further movement of rocker arm 51, the previously compressed return spring 64 shown in FIG. 2*a* will create an opposing mechanical force that causes rod 63 to displace vertically upward in the said FIG. 2*b* out of contact with conductor 71. It can readily be seen that the electromechanical switch shown in FIGS. 2*a* and 2*b* has a number of complex moving parts to cause the switch to operate between one input port and two output ports. The switch 10 can continuously be operated to return to the first position shown in FIG. 2*a* from the second position shown in FIG. 2*b*, return spring 62 causing rod 61 to move reed 81 out of contact with conductors 71, 72. To achieve the operation of the switch 10 requires two assemblies as shown in FIGS. 2*a* and 2*b* with a duplication of parts. Obviously, the S-switch switch would be larger in volume and mass than the C-switch. The opposing return spring which has a compressed force associated with the switch operation is usually some fraction of the actuator thrust. This can leave the switch vulnerable to contact sticking and hence degrade the reliability of the switch.

Figure 3A:
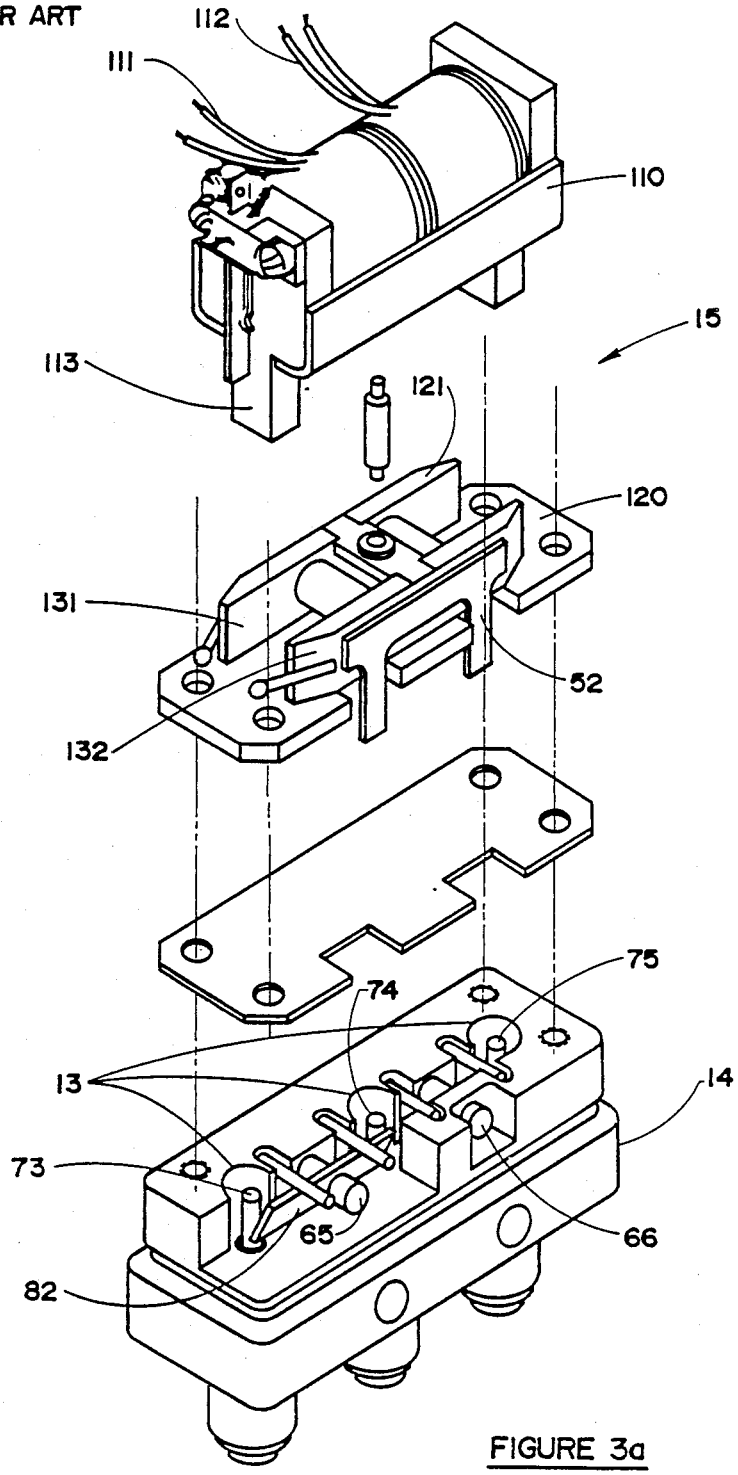
FIG. 3*a* is an exploded perspective view of a prior art electromagnetic and mechanical lever mechanism type of arrangement for the connecting and disconnecting between two adjacent paths.
Figure 3B:
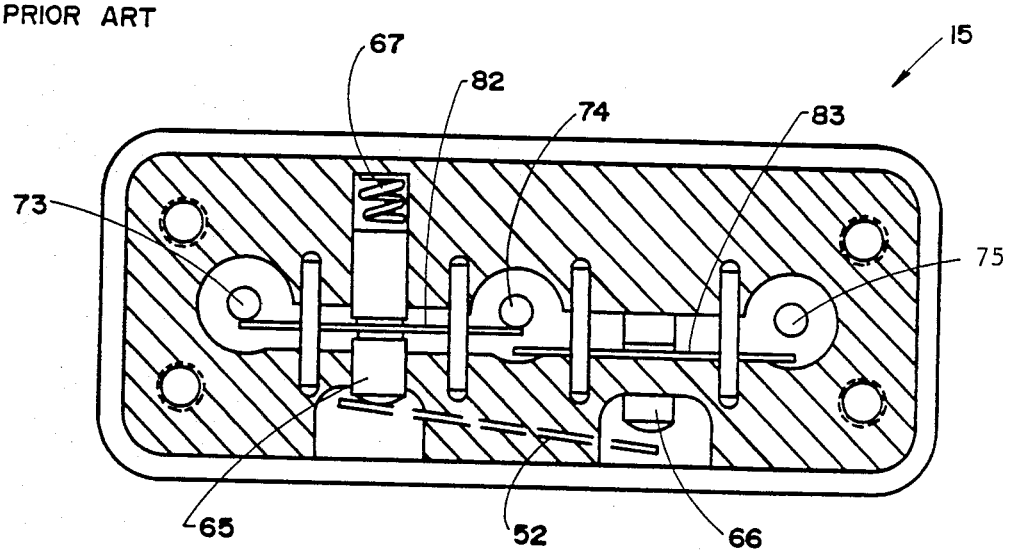
FIGURE 3b PRIOR ART
FIG. 3*b* is a sectional top view of the prior art switch shown in FIG. 3*a;*
Figure 3C:
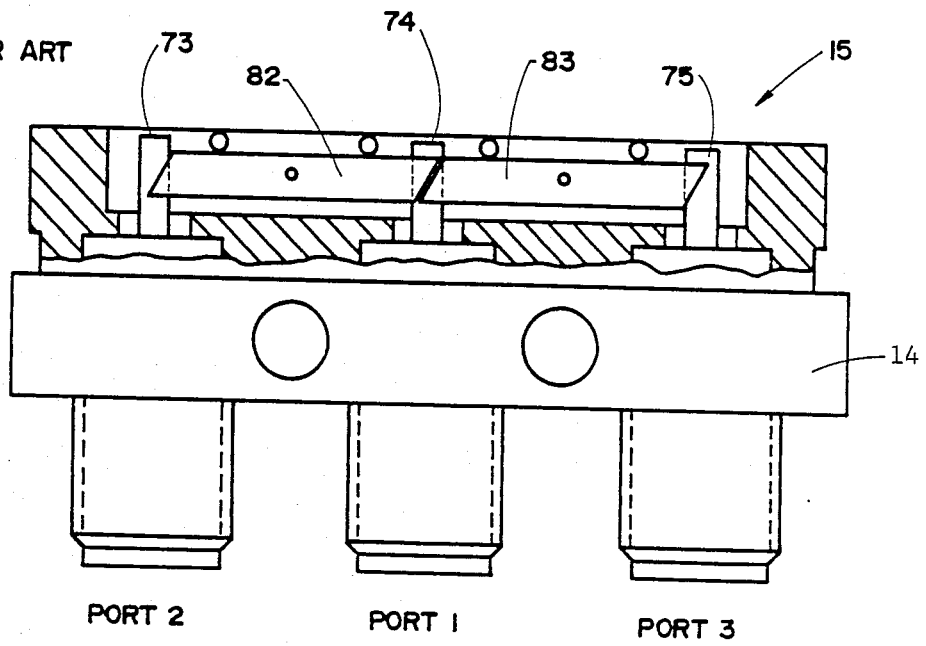
FIG. 3*c* is a partially sectional side view of the prior art switch shown in FIG. 3*a;*

In FIGS. 3*a*, 3*b* and 3*c*, there is shown a prior art electromagnetic switch 15 with a mechanical lever actuated mechanism. The switch 15 has a dual polarity electromagnetic coil 111, 112 configuration, together with an RF cavity assembly 13 housed within a primary housing 14. As the switch 15 is a prior art switch, only those components relevant to the operation of the switch are specifically described. To operate the switch actuator, an electrical current is applied to either winding 111 or 112. The application of such an electrical field will cause a magnetic field to attract the opposite field polarity of a magnetized clapper arm 121. The switch can be activated by applying a current to coil winding 111 that attracts a clapper assembly pole 132 causing clapper arm 121 to rotate in a clockwise direction as shown in FIG. 3*a* until the pole 132 comes to rest at actuator assembly stop 113. In FIG. 3*b* it is shown that the corresponding rotational movement of rocker arm 52 will cause a linear movement of plunger 65 that causes reed 82 to connect with the connector contacts 73, 74, thereby connecting port 1 and port 2. Conversely, when the electrical coil 112 is energized by an electrical current, the clapper magnetic pole 131 will be attracted to the reversed polarity of the magnetic stop 113 that causes the clapper assembly to rotate counterclockwise. This rotational movement in turn causes the rocker arm 52 to apply a linear movement to plunger 66 that moves reed 83 to make contact with connector contacts 74, 75, thereby connecting port 1 and port 3. The compression of return spring 67 in a first position shown in FIG. 3*b* will cause the reed 82 to disconnect from connector contacts 73, 74, thus causing port 2 to be disconnected from port 1. Typical electromagnetic generated coaxial switches are usually of lower mass than solenoid type switches. This type of switch configuration employs a number of components to achieve a translation from the initial set of contacts to the selected set. In addition to the high part count associated with the switch 15 as shown in FIGS. 3*a*, 3*b* and 3*c*, there is a requirement for intricate tolerances and detailed machined finishes which produces an adverse effect with numerous locations of mechanical wear occurring at primary locations such as the clapper assembly, rocker arm, switch reeds and the ends of the push rods.

Figure 4:
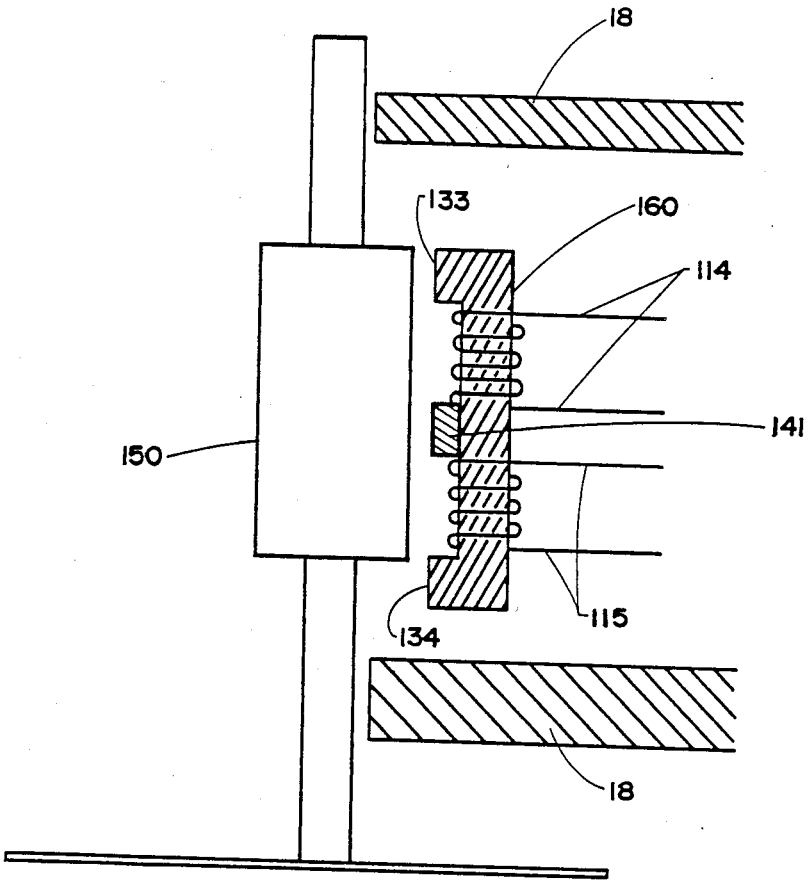
FIG. 4 is a sectional side view of a prior art single phase or one step of an electromagnetic linear actuating device.

In FIG. 4, there is shown a sectional side view of a prior art electromagnetic linear actuating device within a housing 18 (only part of which is shown) that satisfies the basic operating principle of this present invention. The armature is a cylindrical rod 150 of magnetically soft material that is bounded by a stationary magnetic circuit consisting of a permanent magnet 141, two electrical coils 114, 115 that are wound around a back iron 160 which forms a magnetic-reluctance circuit with air gaps of upper return path 133 and lower return path 134. The permanent magnet 141 generates a magnetic flux that enters the armature 150 and may return by the upper path 133 or lower path 134. The air gaps between the armature 150 and the return path present a magnetic reluctance that varies with the armature's vertical position. The armature 150 experiences a mechanical force toward a minimum reluctance position. Latching of the armature to its preferred position is achieved in this manner. This principle presents open and closed latching forces that are equal in magnitude and can be realized easily and repeatedly through careful design of the magnetic circuit. Further, by applying an electrical current to the wound coils 113, 114, an additional or supplementary magnetic circuit is generated comprising the back iron 160, the upper return path 133, the full length of the armature 150, and the lower return path 134. Depending on the polarity and the direction of the coil winding, the resulting field will supplement the permanent magnetic field in one magnetic return path and due to sign convention, will reduce the product of the permanent magnetic field and supplementary field in the opposing return path. This differential of magnetic fields will in turn cause a mechanical force on the actuator in the direction of minimum reluctance. The characteristics of such a magnetic circuit results in a large initial start-up thrust with respect to the final end of travel thrust ensuring maximum assurance of a successful switch operation.

Figure 5:
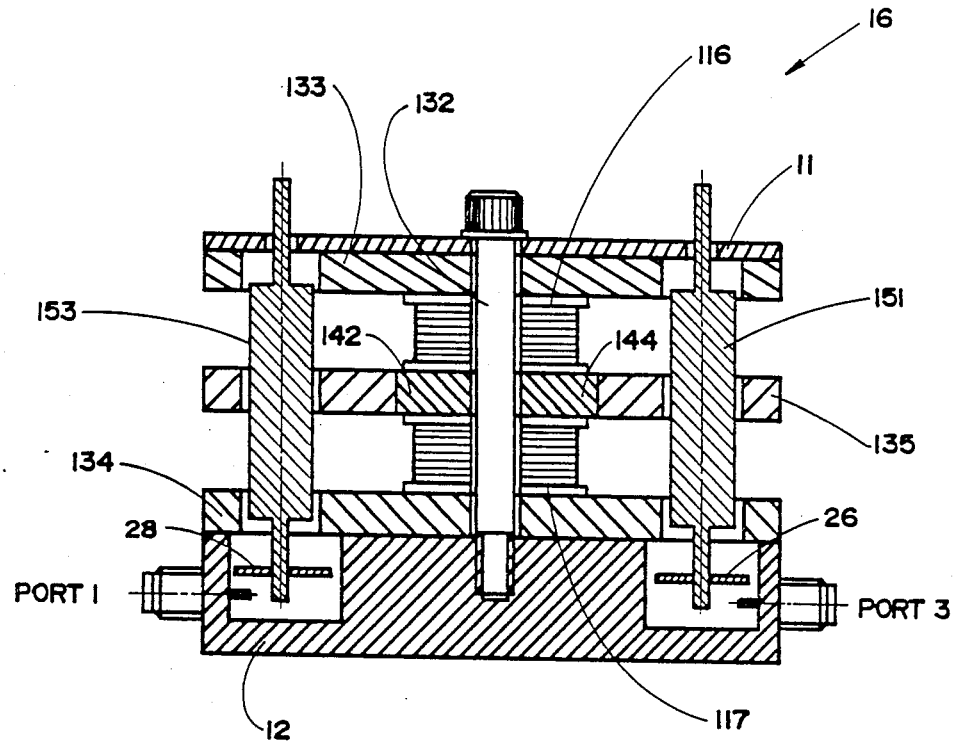
FIG. 5 is a sectional side view of a coaxial S-switch in accord the present invention having electromagnetic means to actuate armatures.

In FIG. 5, there is shown a sectional view of an electromagnetic switch 16 in accordance with the present invention with an RF cavity housing 12 located within a housing 11. Since the actuator mass constitutes approximately 40% to 50% of the total switch mass, it is as important to reduce the actuator mass as it is to reduce the mass of the RF cavity and housing. The switch 16 shown in FIG. 5 will reduce the volume and the number of parts required to be located within the switch housing. Fortunately, any reduction in the mass of the magnetic circuit automatically leads to a reduction in the actuator mass as the size and mass of the actuator is determined by the drive thrust required to linearly displace the armature.

Figure 6:
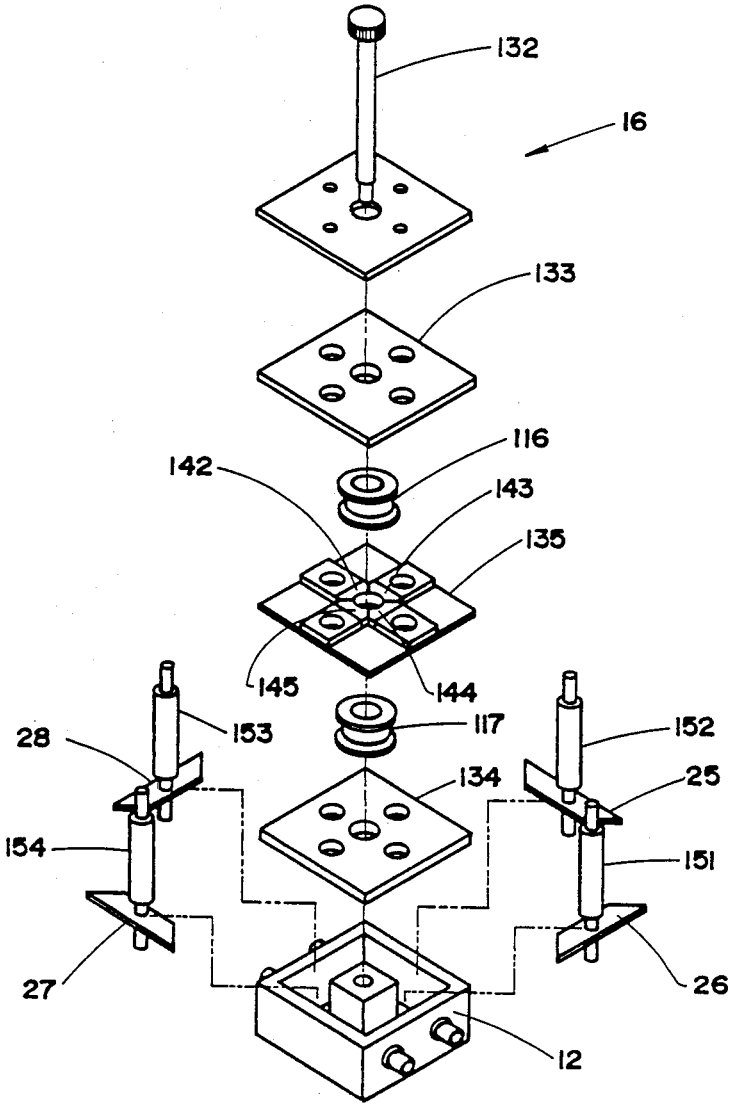
FIG. 6 is an exploded perspective view of the coaxial S-switch of FIG. 5.

From FIGS. 5 and 6, it can be seen that the switch 16 has conductor paths located in the RF cavity housing 12. Four movable connectors 25, 26, 27, 28 are shown which are fastened to four armatures 151, 152, 153 154. The connectors 25, 26, 27, 28 are each long enough to comprise one entire conductor path for the switch 16. The upper and lower magnetic return 133, 134 are separated by a centre plate 135 and upper and lower windings 116 and 117, respectively. To complete the magnetic circuit the magnetic returns, centre plate 135 and upper and lower windings 116, 117 are fastened with a pin 132 that serves as a back iron to the magnetic circuit. Four permanent magnets 142, 143, 144, 145 are supported on the centre plate 135, one for each of the armatures 153, 152, 151, 154 respectively. The magnets are oriented as such that opposite armatures say 152, 154 experience the same magnetic polarity. The two magnets for the two remaining armatures 151, 153 respectively are oriented with an opposite or opposing magnetic field. In other words, the armatures 152, 154 oppose the armatures 151, 153. An electrical pulse supplied to either of the coil windings 116, 117 will cause one set of opposing armatures 152, 154 to rise, thus disconnecting the attached connector from the respective conductor path in which it is located and interrupting said path. During the execution of the same electrical pulse the remaining pair of armatures 151, 153 will simultaneously lower, thus causing a connection between their respective connectors and conductor paths. The coil windings can be configured to operate the switch to satisfy two principles.

The winding direction of coils 116, 117 can be utilized electrically to function in a series or parallel circuit arrangement. The advantage of an independent coil with the alternative parallel circuit will permit redundance if one coil should fail or an additional margin of the applied voltage with reference to the switching threshold applied voltage. Such an arrangement can provide a switch margin of up to six times the threshold drive current.

The S-switch 16 is drawn approximately to scale and it can readily be seen that the switch 15 has many fewer moving parts than the prior art S-switch 10, 15, thus providing an increase in reliability. Further, the switch 16 can be much smaller than the switches 10, 15 resulting in a reduction in mass and volume. Since there are numerous C-switches and S-switches used in most communication satellites any mass or volume saving can result in a substantial overall saving. Since the switch of the present invention has fewer moving parts, it is less likely to fail than prior art switches.

Figure 7:
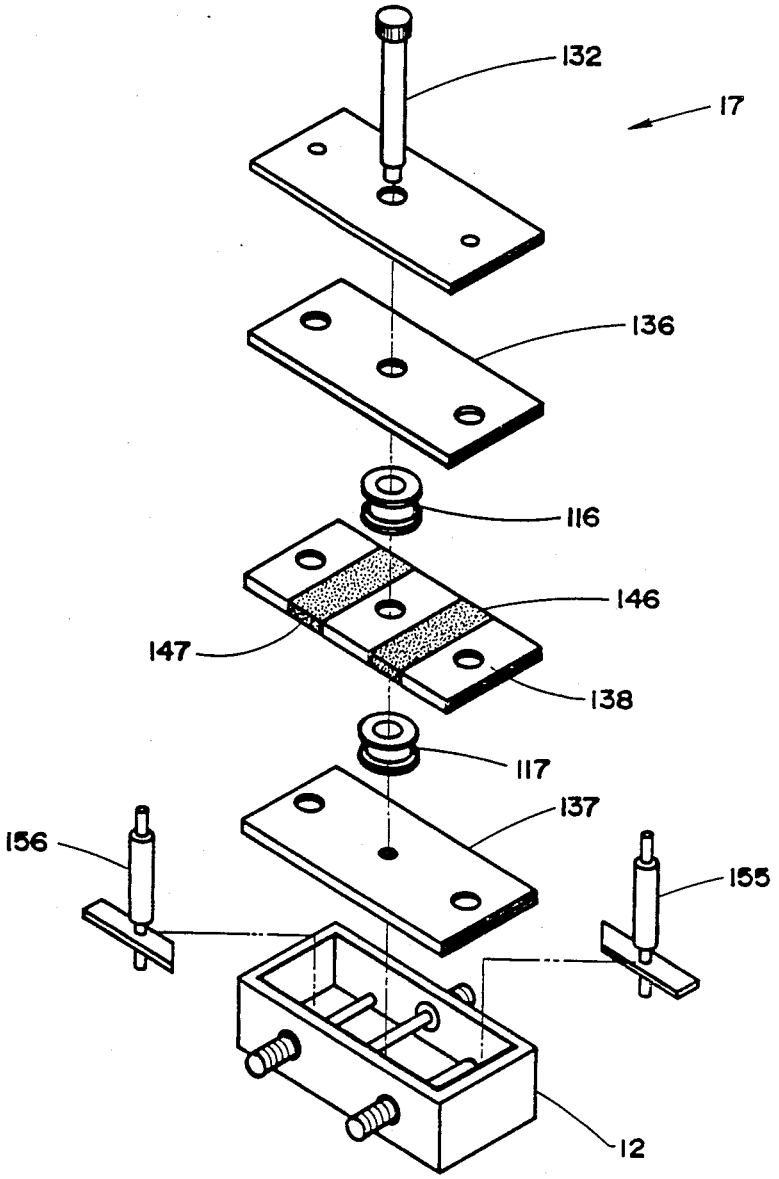
FIG. 7 is an exploded perspective view of a coaxial C-switch in accordance with the present invention.

In FIG. 7, there is shown a perspective view of a coaxial C-switch 17 in accordance with the present invention. In this embodiment, an RF cavity housing 12 has three ports. An actuator is fitted with two armatures 155, 156. Permanent magnets 146, 147 are oriented in an opposite sense with respect to polarity on a centre plate 138. The magnetic circuit is completed b an upper magnetic return 136, a centre back iron 132, an a lower magnetic return 137. Application of an electrical current pulse to coils 116, 117 will cause one armature 155 to rise thus disconnecting the associated RF circuit. The other armature 156 will simultaneously lower thus connecting its associated RF circuit. Reversing the sense of the applied current pulse will reverse the resulting motion of the two armatures thus realizing the functions of a C-switch. At any given time, one conductor path will be complete-d and the other conductor path will be interrupted.

Numerous variations within the scope of the attached claims will be readily apparent to those skilled in the art.

What I claim as may invention is:

1. A microwave switch comprising a housing containing an electromagnetic actuator and at least two conductor paths interconnecting at least three ports, said actuator having a plurality of armatures and electromagnetic means for moving said armatures, said armatures being seated in said housing and each armature having a first position and a second position that are linearly displaced from one another, each armature being located relative to the electromagnetic means so that movement of each armature from one position to the other can be controlled by said electromagnetic means simultaneously with the movement of the other armatures each armature having connectors thereon so that one conductor path in said switch is connected in one position of the armature and interrupted in the other position, the movement of all of the armatures being coordinated so that appropriate paths are connected and interrupted simultaneously the armature and the connectors mounted thereon being the only moving components of the switch, there being no movable mechanical connection between the electromagnetic means and the armatures and the electromagnetic means remaining stationary.

2. A switch as claimed in claim 1 wherein the electromagnetic means are one permanent magnet for each armature, at least one coil winding and means for passing a direct current through the winding.

3. A switch as claimed in claim 2 wherein the permanent magnets for any of the armatures that are intended to move in the same direction are oriented to have the same polarity and the permanent magnets for those armatures that are intended to move in opposite directions being oriented to have opposing polarity.

4. A switch as claimed in claim 3 wherein the armatures are made at least partially of a magnetically soft material.

5. A switch as claimed in any one of claims 1, 2 or 4 where there is one coil winding in the switch and a reversible power source, the armatures being moved from a first position to a second position by passing current through the winding in one direction and the armatures are moved from a second position to a first position by passing current through the winding in the opposite direction.

6. A switch as claimed in any one of claims 1, 2 or 4 wherein there are two coil windings in the switch, each winding being wound in an opposite direction, with means for switching the current between the two windings, the armatures being moved from a first position to a second position by passing current through one of the windings and the armatures being moved in an opposite direction by passing current through the other winding.

7. A switch as claimed in any one of claims 1, 2 or 4 wherein there are two coil windings connected in parallel to a reversible power source so that if one winding breaks down, the other winding can still operate the switch.

8. A switch as claimed in claim 4 wherein there are four ports and four armatures with four conductor paths, one conductor path extending between ports one and two, one path between ports two and four, one path between ports one and three and one path between ports three and four, said switch being an S-switch.

9. A switch as claimed in claim 8 wherein the switch contains two coil windings.

10. A switch as claimed in claim 9 wherein the housing is rectangular in shape and the four ports are located opposite one another, there being two ports in each of two opposing side walls.

11. A switch as claimed in claim 10 wherein each armature is capable of connecting or interrupting the conducting path in which it is located, the armatures being co-ordinated so that in a first position, ports one and three are connected and ports two and four are connected, the remaining conductor paths being interrupted and, in a second position, ports one and two are connected and ports three and four are connected, the remaining conductor paths being interrupted.

12. A switch as claimed in claim 11 wherein the cross-sectional area of the switch normal to the coil windings of the actuator is less than 1.9 square inches.

13. A switch as claimed in claim 4 wherein the switch has three ports and two armatures, with two conductor paths, one conductor path extending between ports one and two and the other conductor path extending between ports one and three, the switch being a C-switch.

14. A switch as claimed in claim 13 wherein the first port is located on one side of the housing and ports two and three are located on an opposite side of the housing.

15. A switch as claimed in claim 14 wherein each armature is capable of connecting or interrupting the conductor path in which it is located, the armatures being co-ordinated so that in a first position, ports one and two are connected and the remaining conductor path is interrupted and, in a second position, ports one and three are connected and the remaining conductor path is interrupted.

* * * * *